US009261338B2

(12) United States Patent
Saxby

(10) Patent No.: US 9,261,338 B2
(45) Date of Patent: Feb. 16, 2016

(54) MARKER PROJECTILE

(75) Inventor: Michael Ernest Saxby, Eastbourne (GB)

(73) Assignee: UTM IP LIMITED, Mildenhall (GB)

( * ) Notice: Subject to any disclaimer, the term of this patent is extended or adjusted under 35 U.S.C. 154(b) by 0 days.

(21) Appl. No.: 13/982,655

(22) PCT Filed: Feb. 2, 2012

(86) PCT No.: PCT/GB2012/000111
§ 371 (c)(1),
(2), (4) Date: Oct. 15, 2013

(87) PCT Pub. No.: WO2012/104590
PCT Pub. Date: Aug. 9, 2012

(65) Prior Publication Data

US 2014/0026778 A1 Jan. 30, 2014

(30) Foreign Application Priority Data

Feb. 2, 2011 (GB) ..... 1101809.0

(51) Int. Cl.
*F42B 12/40* (2006.01)
*F42B 12/36* (2006.01)

(52) U.S. Cl.
CPC ..... *F42B 12/40* (2013.01)

(58) Field of Classification Search
CPC ..... F42B 12/40; F42B 12/36
USPC ..... 102/502, 511, 512, 513
See application file for complete search history.

(56) References Cited

U.S. PATENT DOCUMENTS 397,031 A * 1/1889 Silas ..... 102/366
3,037,454 A * 6/1962 Young ..... 102/439

(Continued)

FOREIGN PATENT DOCUMENTS

GB 2346201 8/2000
GB 2389167 12/2003

OTHER PUBLICATIONS

International Preliminary Report on Patentability and Written Opinion for Application No. PCT/GB2012/000111, 5 pages, dated Aug. 6, 2013.

(Continued)

*Primary Examiner* — Bret Hayes
(74) *Attorney, Agent, or Firm* — Nelson Mullins Riley & Scarborough LLP; Anthony A. Laurentano

(57) ABSTRACT

The invention provides a marker projectile a hollow body (4) having an opening at the front; a marker substance (3) disposed within the hollow body (4); and an expelling member (5) within the hollow body (4) behind the marking substance (3); the hollow body (4) and expelling member (5) being configured such that upon impact of the projectile with a target, the momentum of the expelling member (5) relative to the hollow body (4) carries the expelling member (5) forwardly to expel the marking substance (3) through the opening, a separator (1) extending at least partly over the front opening, the separator (1) defining two or more spaces through which the marker substance (3) may pass when expelled through the opening and characterized by a deformable closing member (2) positioned between the marking substance (3) and the separator (1), the closing member (2) configured to deform under the impact of the travelling expelling member (5) whereby to release the marking substance (3) from the hollow body (4).

13 Claims, 2 Drawing Sheets

(56) References Cited

U.S. PATENT DOCUMENTS

| | | | | |
|---|---|---|---|---|
| 4,448,106 | A * | 5/1984 | Knapp | 89/1.11 |
| 5,018,449 | A * | 5/1991 | Eidson, II | 102/498 |
| 5,233,128 | A | 8/1993 | Lai | |
| 5,654,524 | A * | 8/1997 | Saxby | 102/513 |
| 6,871,594 | B1 * | 3/2005 | Estrella | 102/498 |
| 7,690,311 | B1 | 4/2010 | Cronemberger | |
| 2005/0229807 | A1 * | 10/2005 | Brock et al. | 102/502 |
| 2005/0284325 | A1 * | 12/2005 | Saxby | 102/502 |

OTHER PUBLICATIONS

International Search Report for Application No. PCT/GB2012/000111, 4 pages, dated May 29, 2012.

* cited by examiner

MARKER PROJECTILE

RELATED APPLICATIONS

This application is a 35 U.S.C. 371 national stage filing of International Application No. PCT/GB2012/000111, filed Feb. 2, 2012, which claims priority to Great Britain Patent Application No. 1101809.0 filed on Feb. 2, 2011 in Great Britain. The contents of the aforementioned applications are hereby incorporated by reference.

The present invent relates to a marker projectile and to the combination of a marker projectile and a cartridge.

BACKGROUND

Marker projectiles for use in training or war games are well known and examples of such projectiles are disclosed in U.S. Pat. No. 4,686,905, GB 2 284 252, GB 1 263 522, U.S. Pat. No. 3,528,662, U.S. Pat. No. 4,128,059 and U.S. Pat. No. 3,782,286.

Most of the aforementioned patents disclose projectiles in which a marker substance is held within a frangible casing or enclosure which ruptures upon impact with a target. A problem with projectiles such as bullets that are intended to break upon impact is that sometimes they fail to break. Moreover, because of the high impact required to break the frangible casing or enclosure, the projectiles can often cause injury upon impact with a person. A further problem is that the frangible casings or enclosures can sometimes break in a gun during the gun's reloading cycle.

Some of the aforementioned problems are addressed in GB 2 284 252 which discloses a projectile comprising a hollow casing having a perforated nose portion, a piston disposed within the casing, and a marking substance disposed forwardly of the piston. The piston is movable forwardly under force applied to it by gas used to discharge the projectile thereby compressing the marking substance and expelling it through the nose portion which thus becomes coated with the marking substance. Upon impact with a target, the marking substance is transferred to the target to mark the target.

However, a problem with projectiles, such as those disclosed in GB 2 284 252, in which the nose portion of the projectile is coated with a marking substance even before the projectile has left the gun barrel, is that the marking substance is dispersed by the rotation imparted to the projectile by the rifling in the gun barrel. Thus, the centrifugal force imparted by the spinning bullet causes the marking substance to move radially outwardly and consequently it can foul the barrel of the gun. A build up of marking substance, or its thermal decomposition products, in the gun barrel over time will inevitably have an adverse effect on the working of the gun. This problem is greatly exacerbated with bullets designed for use in high velocity rifles such as the NATO and US 5.56 mm calibre rifles where the rifling in the barrel must be such as to impart a very high spin rate to the bullet in order to ensure a stable trajectory. Even with relatively low velocity training ammunition, the high spin rates imparted by the rifling in high velocity rifles are still sufficient to cause the marking substance to disperse in the manner described above.

A still further problem with the marker projectile of GB 2 284 252 and other known marker projectiles is that they are unsuitable for small calibre barrels such as the current NATO and US 5.56 mm calibre self loading rifle barrels. This is not only because of the problem of radial dispersion of the marking substance referred to above, but also because the complexity of the bullet poses considerable manufacturing difficulties with smaller calibre bullets.

International Patent Application number PCT/GB00/00241 discloses a marker projectile which goes some way to overcoming the aforementioned technical problems. The marker projectile in that patent specification is characterised by a marker substance being disposed in a hollow chamber with a front opening. An expelling member is positioned behind the marker substance with respect to the front opening. The configuration of the projectile is such that, on impact with a target, the momentum of the expelling member relative to the hollow body carries the expelling member forwardly towards the impacted target so as to expel the marking substance in a low impact manner. These marker projectiles are distinguished from known projectiles such as those disclosed in GB 2 284 252 where a piston within the projectile is driven forwardly by the propellant gases in the cartridge or gun to expel the marker substance. In the projectiles described in PCT/GB001/00241, the expelling member is insulated from the propellant gases; in other words, the propellant gases do not act on the expelling member to force it forwardly to cause expulsion of the marking substance.

The family of patents derived from the Applicant's own earlier international patent application number PCT/GB03/02344 discloses a solution to improve the spread of a marker substance expelled by a non-lethal, low impact projectile of the type described in PCT/GB00/00241. PCT/GB03/02344 describes a non-lethal marker projectile comprising a hollow body having an opening at the front; a marker substance disposed within the hollow body; and an expelling member within the hollow body behind the marking substance; the hollow body and expelling member being configured such that upon impact of the projectile with a target, the momentum of the expelling member relative to the hollow body carries the expelling member forwardly to expel the marking substance through the opening and characterised by a separator extending at least partly over the front opening, the separator defining two or more spaces through which the marker substance may pass when expelled through the opening.

The present invention seeks to provide a marker projectile which provides further improved marking over a wide range of temperatures.

SUMMARY OF THE INVENTION

In accordance with the present invention, there is provided a non-lethal marker projectile comprising a hollow body having an opening at the front; a marker substance disposed within the hollow body; and an expelling member within the hollow body behind the marking substance; the hollow body and expelling member being configured such that upon impact of the projectile with a target, the momentum of the expelling member relative to the hollow body carries the expelling member forwardly to expel the marking substance through the opening, a separator extending at least partly over the front opening, the separator defining two or more spaces through which the marker substance may pass when expelled through the opening and characterised by a deformable closing member positioned between the marking substance and the separator, the closing member configure to deform under the impact of the travelling expelling member whereby to release the marking substance from the hollow body.

The inventor has found that, whilst introducing greater liquidity into the marker substance can result in more prominent marking of the target and permit effective marking in a wider range of temperatures than is presently achievable with marker substances currently in use, to do this results in problems during shipment and in the projectile's transit through the weapon. In these circumstances, more liquid substances are prone to leak creating a mess but also leaving insufficient marker substance in the projectile to provide a prominent mark on the target when the weapon is fired.

The problem is solved by the introduction of a deformable closing member which is able to contain the marker substance during transit, but which, under the load of a fired projectile, deforms releasing the marker substance to provide a mark much as in the prior art. The introduction of the closing member makes it practical to use more liquid marker substances which extend the range of temperatures in which the marker projectile can properly function and which splay further on impact with a target to provide a more prominent mark.

In a most simple and convenient embodiment, the deformable closing member comprises a disc having a diameter substantially the same as the outside diameter of the hollow body, and is positioned over the end of the hollow body and is held in position by the separator. When the expelling member impacts on the disc, the disc deforms into a domed shape and so acquires a smaller outside diameter allowing it to travel forward towards the separator providing an annular passage through which the marking substance is able to pass.

Conveniently, the disc comprises a deformable plastic material. Desirably the deformable plastic material has a thickness of from about 0.001 to 0.006 inches (approximately 0.025 to 0.15 mm).

Whilst the disc embodiment provides a very simple, cheap and easy to implement embodiment, other embodiments will no doubt occur to a skilled addressee. For example, but without limitation, such embodiments might include a domed, conical or truncated conical member, flat star shaped or polygonal members.

Whilst the disc embodiment is proposed to be positioned between the hollow body and the separator, the disc or other embodiments of closing member may be retained in position by other means, for example, they might be configured to fit into the end of the hollow body or be retained by some form of retaining groove or protruding means provided on the inner facing surface of the hollow body or separator.

The separator may conveniently be provided in the form of a cap which is secured to an outer wall or edge of the hollow body adjacent the front opening. Desirably, such a cap is secured in such a way that the aerodynamic properties of the projectile are not significantly compromised. The separator conveniently comprises one or more arms extending between the periphery of the front opening and the centre of the front opening. Optionally, the arms extend symmetrically from the centre to the periphery of the opening. Preferably, there are between two and four arms, desirably, there are three arms. Optionally, the separator has a domed configuration, the peak of the dome sitting in substantial alignment with the centre of the front opening.

Conveniently, a collar at the end of the hollow body adjacent the opening is provided with a peripheral protrusion, such as an angled flange, over which a complementary inner surface of the separator may be snap fit into position. Alternative means for securing the separator to the hollow body will not doubt occur to the skilled addressee and may, without limitation, include; providing complementary screw threads so that the separator can be screwed into position on the body, press fitting, spot welding, gluing or clipping.

The provision of the separator causes the marker substance, when propelled by the expelling member to be separated by a barrier (such as an arm) provided by the separator and to be expelled through the available spaces between elements of the barrier. This causes spreading of the marker substance over the target area, in a manner similar to water flowing through a sprinkler head, the mark on the target becoming more visible from a distance.

In one embodiment, the hollow body comprises a sleeve having a core body portion secured within a rear end thereof, the inner wall of the sleeve and a forwardly facing surface of the core body portion defining a chamber within which the marking substance and expelling member are disposed. The sleeve typically has a cylindrical form, a spigot portion of the core body member being received (preferably non-slidably) within the rear end of the sleeve. The sleeve is preferably formed from a material having a greater density than the material from which the core body portion is formed. Thus, for example, the sleeve can be formed from a metal material such as aluminium and the core body portion can be formed from a plastics material. The advantage of this feature is that (with the exception of the expelling member) the mass of the hollow body is concentrated towards its outer circumference which improves its ballistic properties.

It is most preferred that the hollow body is provided with means for centring the expelling member therein during flight of the projectile. By providing centring means, lateral movement of the expelling member during flight is prevented and the destabilising effect of such movement is therefore avoided. The centring means can be a recess in a forwardly facing surface within the interior of the hollow body. Where the hollow body comprises a core body portion and a sleeve, the centring means can comprise a recess in the forwardly facing surface of the core body portion. The recess constituting the centring means can be conical, frustoconical, hemispherical or part hemispherical, for example.

The expelling member can take a variety of shapes provided that it is rotationally symmetrical about its longitudinal axis. Preferably, it is of a spherical shape and more preferably it is a solid sphere.

The expelling member is typically formed from a material having a greater density than the material(s) from which the hollow body is formed. Thus, for example, the expelling member can be formed from steel. Where the projectile comprises a sleeve and core body portion, it is preferred that the expelling member has a greater density than the sleeve and the core body portion. It will appreciated also that, typically, the expelling member will have a density greater than the density of the marking substance.

In order to ensure that the expelling member can be carried forwardly by its own momentum within the hollow body upon impact with a target without its motion being retarded by frictional engagement with an inner surface of the hollow body, there is preferably a radial clearance between the centred expelling member and the inner wall of the hollow body (e.g. sleeve) sleeve.

In the projectiles of the invention, the motivating force urging the expelling member forwardly against the marking substance is the expelling member's own momentum. There is no need for a piston/cylinder arrangement driven by the expanding propellant gases within the gun barrel upon firing. On the contrary, where a core body portion/sleeve arrangement is used, means are typically provided for preventing forward movement of the core body portion in the manner of a piston relative to the sleeve. Such means can take the form of an abutment surface, for example an abutment flange, on the core body portion which rests against a rearwardly facing surface of the sleeve.

The present invention also contemplates the combination of a cartridge and a marker projectile as hereinbefore defined.

BRIEF DESCRIPTION OF THE DRAWINGS

For the purposes of exemplification, a preferred embodiment of the invention is now described with reference to the following Figures in which.

DESCRIPTION OF THE PREFERRED EMBODIMENT

Figure 1:
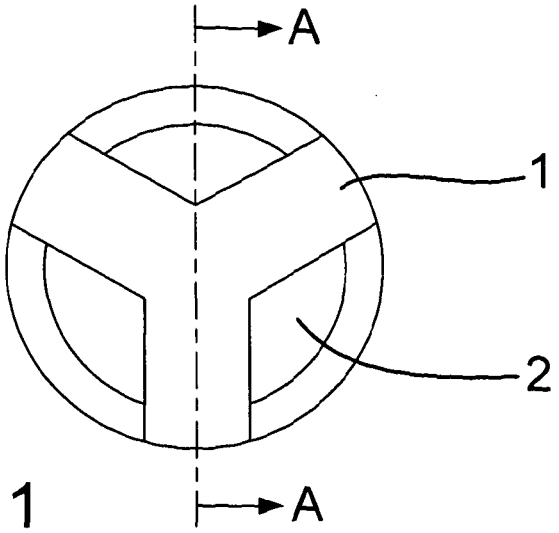
FIG. 1 shows an end view of one embodiment a projectile of the invention.
Figure 2:
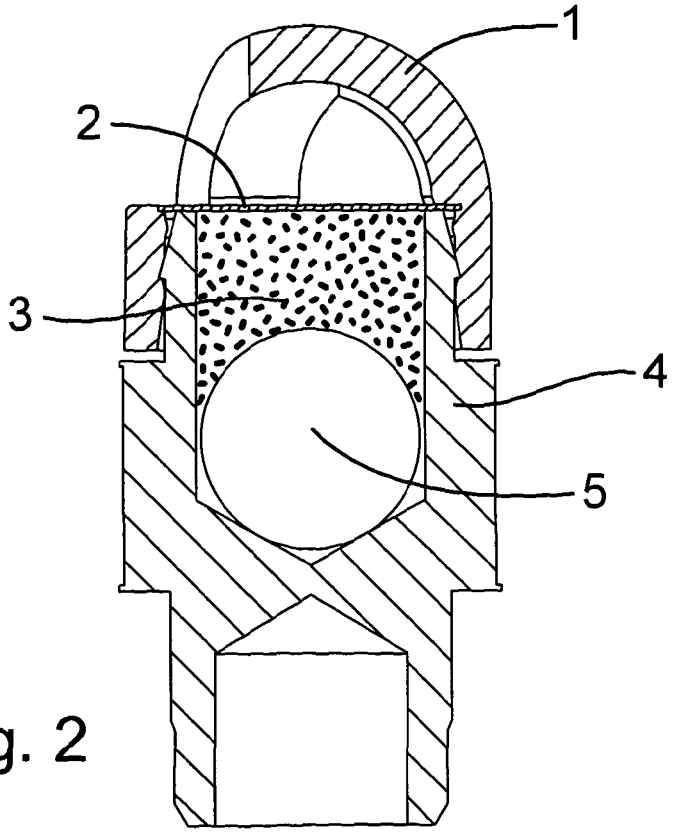
FIG. 2 shows a longitudinal section (A-A) through the embodiment of FIG. 1 before the expelling member is caused to travel.
Figure 3:
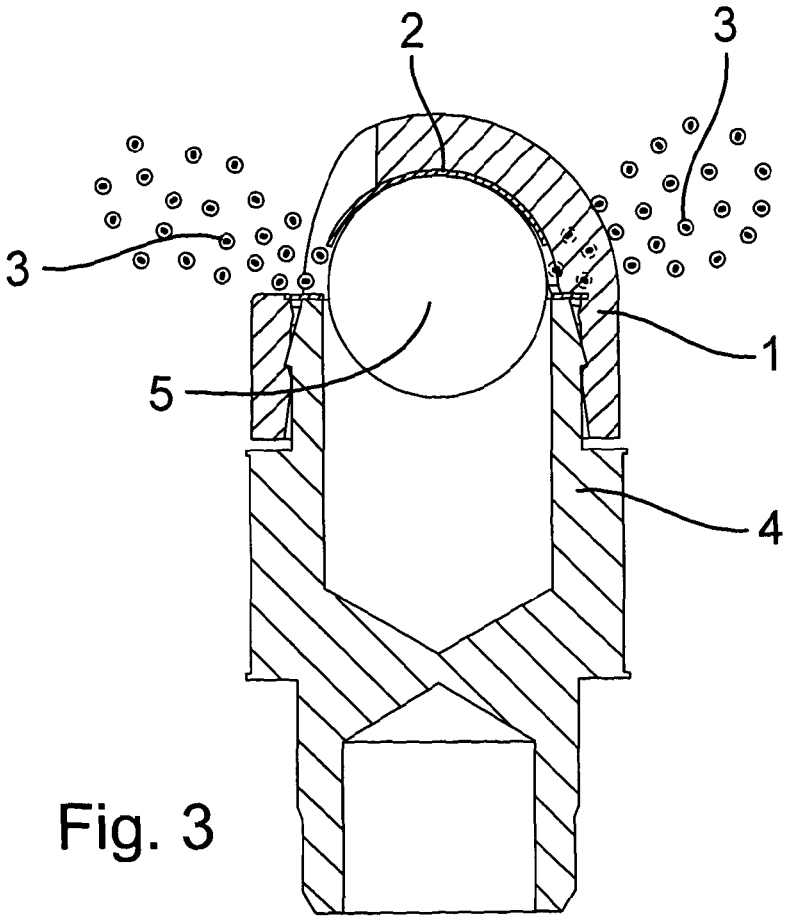
FIG. 3 shows a longitudinal section (A-A) through the embodiment of FIG. 1 after the expelling member has travelled.

As can be seen in FIG. 1, a separator 1 sits at the front end of a marker projectile and is secured to an open end of a hollow body (shown in FIGS. 2 and 3). Immediately behind the separator 1 is a circular disc 2 comprised of a thin circular sheet of deformable plastic.

As can be seen in FIG. 2, the disc 2 is sandwiched between the separator 1 and an open end of a hollow body 4. Carried in the hollow body 4 is a supply of marking fluid 3 behind which sits an expelling member in the form of a ball bearing 5.

FIG. 3 shows the changes that occur after the projectile is fired. As a target is hit by the separator end 1, the projectile ceases to travel, however, momentum causes the expelling member 5 still to move forward within the chamber of the hollow member 4 and forces the marker substance 3 against the disc 2. The disk, 2 is caused to deform and slips out of its sandwiched position between the separator 1 and body 4. The marker substance 3 is consequently allowed to escape the hollow body travel forward and disperse to mark the target.

It is to be understood that the foregoing is purely exemplary of just one embodiment of the invention others of which will no doubt occur to the skilled addressee without departing from the true scope of the invention as defined by the appended claims.

The invention claimed is:

1. A non-lethal marker projectile for firing from a firearm, the projectile having a front and a rear, comprising a body having a chamber and an opening at the front, wherein the body is sized and dimensioned for firing from the firearm;

a marker substance disposed within the chamber;

an expelling member within the chamber behind the marking substance;

the body and the expelling member being configured such that upon impact of the front of the projectile with a target, the momentum of the expelling member relative to the body carries the expelling member forwardly to expel the marking substance through the opening, a separator extending at least partly over the opening, the separator defining two or more spaces through which the marker substance passes when expelled through the opening; and a deformable closing member positioned and retained between the body and the separator;

wherein the deformable closing member is positioned over an end of the hollow body and is held in position by the separator; and wherein the deformable closing member is at least partially detachable from the body and is configured to detach and to deform when directly impacted by the expelling member, and wherein the expelling member directly impacts the deformable closing member and at least partially detaches the closing member from the body and drives the closing member into contact with the separator and in response to being impacted by the expelling member expels the marker substance from the hollow body.

2. A non-lethal marker projectile as claimed in claim 1, wherein the deformable closing member comprises a disc having a diameter substantially the same as an outside diameter of the hollow body.

3. A non-lethal marker projectile as claimed in claim 2, wherein the disc is formed of a deformable plastic material.

4. A non-lethal market projectile as claimed in claim 2, wherein the disc has a thickness of from about 0.001 to 0.006 inches.

5. A non-lethal marker projectile as claimed in claim 1, wherein the separator comprises a cap which is secured to an outer wall or edge of the hollow body adjacent the front opening.

6. A non-lethal marker projectile as claimed in claim 1, wherein the separator comprises one or more arms extending between a periphery of the front opening and a center of the front opening.

7. A non-lethal marker projectile as claimed in claim 6, wherein the arms extend symmetrically from the center to the periphery of the front opening.

8. A non-lethal marker projectile as claimed in claim 6, wherein the separator comprises two, three or four arms.

9. A non-lethal marker projectile as claimed in claim 1, wherein the separator has a domed configuration, where a peak of the dome is disposed in substantial alignment with a center of the front opening.

10. A non-lethal marker projectile as claimed in claim 1, wherein that the expelling member is formed from a material having a greater density than the material from which the hollow body is formed.

11. A non-lethal marker projectile as claimed in claim 10, wherein the expelling member is formed from steel.

12. A non-lethal marker projectile as claimed in claim 1, wherein the expelling member is spherical.

13. A non-lethal marker projectile as claimed in claim 1, wherein the marker substance is provided in a semi-liquid form.

* * * * *